US008220726B2

(12) United States Patent
Qiu et al.

(10) Patent No.: US 8,220,726 B2
(45) Date of Patent: Jul. 17, 2012

(54) ADJUSTABLE MODULE SPRAY HEAD AND ADJUSTING METHOD THEREOF

(75) Inventors: Jiasen Qiu, Shen Zen (CN); Meng-Feng Cheng, Taichung (TW); Yuansheng Chen, Shen Zen (CN); Changwen Zhang, Shen Zen (CN); Yao Lu, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 400 days.

(21) Appl. No.: 12/568,758

(22) Filed: Sep. 29, 2009

(65) Prior Publication Data

US 2011/0073678 A1 Mar. 31, 2011

(51) Int. Cl.
*A62C 31/00* (2006.01)

(52) U.S. Cl. ..... 239/449; 239/558; 239/560; 239/561; 239/561.1

(58) Field of Classification Search ..... 239/394, 239/442–449, 558–561, 581.1
See application file for complete search history.

(56) References Cited

U.S. PATENT DOCUMENTS 5,201,468 A * 4/1993 Freier et al. ..... 239/383
6,533,194 B2 * 3/2003 Marsh et al. ..... 239/383
6,607,148 B1 * 8/2003 Marsh et al. ..... 239/447

* cited by examiner

*Primary Examiner* — Christopher Kim

(57) ABSTRACT

An adjustable module spray head and adjusting method thereof comprises a module core unit having a holder, a distributing set rotating relative to the holder, two plugs, and a rotatable positioning structure between the holder and the distributing set; the module core unit is used to assembled with various spray heads with different watering levels to meet different demands by selecting an installing position of a levering pin of the rotatable positioning structure and by removing at least one stator or a rotor of the adjustable levering assembly.

9 Claims, 13 Drawing Sheets

ADJUSTABLE MODULE SPRAY HEAD AND ADJUSTING METHOD THEREOF

BACKGROUND OF THE INVENTION

1. Field of the Invention

The present invention relates to an adjustable module spray head and adjusting method thereof which can adjust watering levels based on different demands.

2. Description of the Prior Art

Conventional multi-function spray head is provided a plurality of watering levels to satisfy different demands, however, it is produced at a high cost.

Besides, different spray heads include different parts and structures that have to apply different molds to produce them, thus increasing manufacture time and inventory parts.

The present invention has arisen to mitigate and/or obviate the afore-described disadvantages.

SUMMARY OF THE INVENTION

The primary object of the present invention is to provide an adjustable module spray head and adjusting method thereof which includes a module core unit assembled to various spray heads with different watering levels to satisfy different demands, thus lowering mold, maintenance, and related parts costs.

Further object of the present invention is to provide an adjustable module spray head and adjusting method thereof which is assembled by selecting the installing position of levering pin and removing specific stator or rotor, thus assembling easily and quickly.

Another object of the present invention is to provide an adjustable module spray head and adjusting method thereof which includes two plugs used to urge water to increase stability between the holder and the distributing set to prevent from slanted swing, thereby having stable watering flow.

An adjustable module spray head according to an embodiment of the present invention comprises a module core unit to spray water flowers in various watering modes, the module core unit further comprising a holder including a passage to flow water and two symmetrical slots in communication with the passage to flow water outward;

a distributing set operated to rotate relative to an outflow side of the holder and including a plurality of sets of inlets, each set having two symmetrical inlets arranged around a concentric central point of the distributing set; the distributing set also including a number of outlets disposed on an outflow side thereof, and a plurality of chambers, each communicating with the inlet and the outlet so that water from each set of inlet flows through the chamber to be sprayed outward from each outlet in different watering modes;

two plugs disposed to the slots of the holder to abut against an inflow side of the distributing set, and each plug having an opening formed therein so that when the distributing set rotates, the opening of the plug communicates with one set of inlet to guide water from the holder to the inlet;

a rotatable positioning structure fixed between the holder and the distributing set and including a levering pin, a receiving groove to receive the levering pin, and a plurality of engaging orifices located in a first rotary zone and a second rotary zone; wherein between any two adjacent engaging orifices in the first and the second rotary zones is formed a first angle, and between two adjacent engaging orifices on a connection of the first and the second rotary zones is formed a 22.5 degree of second angle, and the levering pin is rotated with the distributing set to be retained with any one engaging orifice of the first rotary zone to generate single watering mode or to be retained with any one engaging orifice of the second rotary zone to generate double watering mode;

an adjustable levering assembly fixed between the holder and the distributing set and including a plurality of stators and a rotor; wherein the rotor is limited to rotate between two selected stators so that the levering pin rotates between at least two engaging orifices in the first rotary zone; as the rotor is removed before assembly of the holder and the distributing set to increase a rotating angle of the rotor, the levering pin is limited to rotate between more engaging orifices in the first rotary zone or in at least one engaging orifice of the second rotary zone, and as most or all of the stators are removed or as the rotor is removed before assembly of the holder and the distributing set, the levering pin is limited to rotate in all engaging orifices of the first and the second rotary zones, hence the plugs are controlled at least three different angles to communicate with the inlets, generating three watering levels to meet user's demands.

An adjusting method of adjustable module spray head according to another embodiment of the present invention comprises a. providing at least three watering levels before assembling a module core unit;

b. determining one of the following steps based on a selected watering level:

step of without removing, wherein the stators and the rotor are not removed, and the rotor is limited to rotate between two selected stators to assemble the module core unit to achieve the lowest watering level in single watering mode;

first removing step, wherein at least one stator is removed and the rotor is assembled with the two rotating stators in different directions to form the module core unit, thereby generating more watering levels;

second removing step, wherein all stators or the rotor or the stators except for the first stator are removed, and the levering pin is fixed with any engaging orifice of the first and the second rotary zones to form the module core unit, thus obtaining the most watering level;

c. assembling the module core unit to the spray head, having a customized and module spray head.

An adjustable module spray head according to another embodiment of the present invention comprises a module core unit to spray water flowers in various watering modes, the module core unit further comprising a holder including a passage to flow water and two symmetrical slots in communication with the passage to flow water outward;

a distributing set operated to rotate relative to an outflow side of the holder and including a plurality of sets of inlets, each set having two symmetrical inlets arranged around a concentric central point of the distributing set; the distributing set also including a number of outlets disposed on an outflow side thereof, and a plurality of chambers, each communicating with the inlet and the outlet so that water from each set of inlet flows through the chamber to be sprayed outward from each outlet in different watering modes;

two plugs disposed to the slots of the holder to abut against an inflow side of the distributing set, and each plug having an opening formed therein so that when the distributing set rotates, the opening of the plug communicates with one set of inlet to guide water from the holder to the inlet;

a rotatable positioning structure fixed between the holder and the distributing set and including a levering pin, a first receiving groove, a second receiving groove, and a plurality of engaging orifices located in a first rotary zone and a number of engaging orifices in a second rotary zone; wherein the first and the second receiving grooves are symmetrical to each other, and between any two adjacent engaging orifices in the first zone is formed a first angle, between two adjacent engaging orifices in the second rotary zone is formed a 22.5 degree of second angle, and any one of the engaging orifices in the first rotary zone is symmetrical to one of the engaging orifices in the second rotary zone so that the levering pin is installed to one of the first and the second receiving groove, as the levering pin is installed to the first receiving groove, the levering pin is retained with the engaging orifice in the first rotary zone with rotation of the distributing set to generate a plurality of single watering modes; as the levering pin is installed in the second receiving groove, the levering pin is retained with the engaging orifice in the first rotary zone with rotation of the distributing set to generate a plurality of single and double watering modes;

an adjustable levering assembly fixed between the holder and the distributing set and including a plurality of stators and a rotor; wherein the rotor is limited to rotate between two selected stators so that the levering pin rotates between at least two engaging orifices in the first rotary zone or between at least three engaging orifices in the second rotary zone; as at lease one stator is removed before assembly of the holder and the distributing set to increase a rotating angle of the rotor, the levering pin is limited to rotate in the first rotary zone or in at least one engaging orifice of the second rotary zone until the engaging orifices of the first and the second rotary zones are covered, hence the plugs are controlled at least three different angles to communicate with the inlets, obtaining three different watering levels.

An adjusting method of adjustable module spray head according to another embodiment of the present invention comprising a. providing at least three watering levels before assembling a module core unit;

b. determining to install a levering pin to a first or second receiving groove and determining one of the following steps based on a selected watering level:

step of without removing, wherein the stators and the rotor are not removed, and the rotor is limited to rotate between two selected stators to assemble the module core unit, wherein as the levering pin is installed to the first receiving groove and the module core unit is assembled, the lowest watering level is formed, and each watering level is in a single watering mode; as the levering pin is installed to the second receiving groove and the module core unit is assembled, the single and double watering modes are achieved;

step of removing, wherein the selected at least one stator is removed, and the rotor is limited to rotate between two stators rotating opposite to the removed stator to assemble the module core unit; and when the levering pin is selectively installed to the second receiving groove and the step of the removing is finished, the finished module core unit will generate the most watering level in single and double watering mode;

c. assembling the module core unit to the spray head, having a customized and module spray head.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
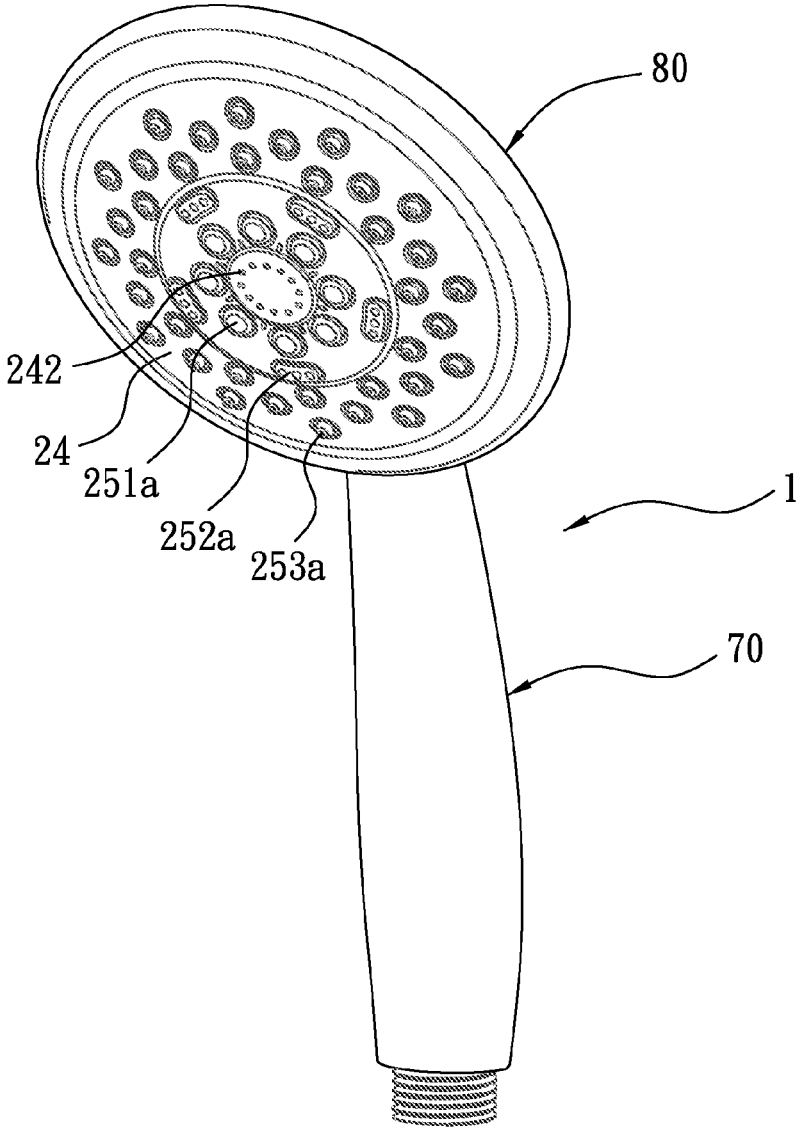
FIG. 1 is a perspective view showing the assembly of an adjustable module spray head in accordance with a first embodiment of the present invention.

Referring to FIG. 1, an adjustable module spray head 1 in accordance with a first embodiment of the present invention comprises a module core unit 2 including a holder 10, a distributing set 20, two plugs 30, a rotatable positioning structure 40, and an adjustable levering assembly 50; the module spray head 1 further includes a water feeding pipe 60, a housing 70, and a rotating ring 80, as shown in FIGS. 2-5.

Figure 6:
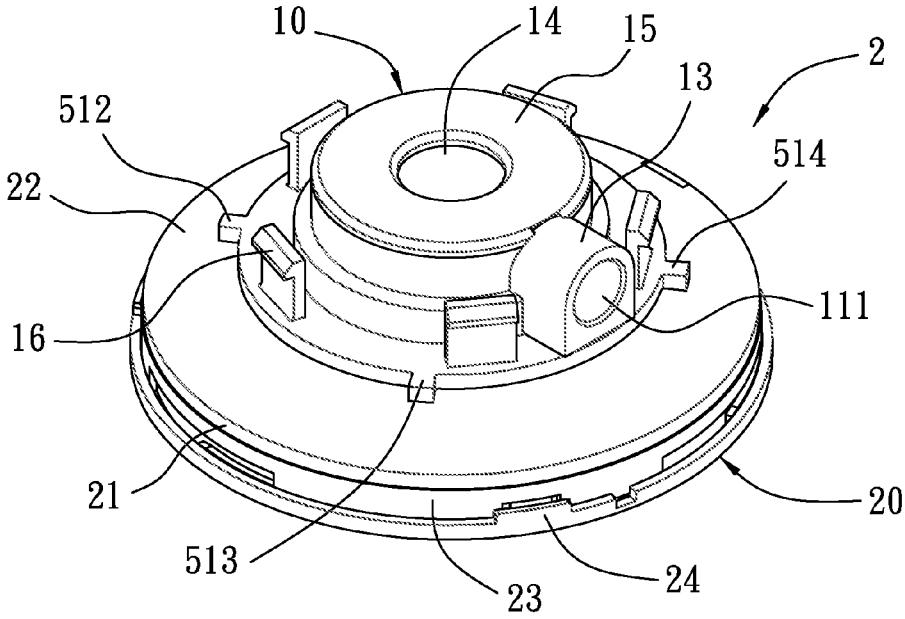
FIG. 6 is a perspective view showing the assembly of a module core unit of the adjustable module spray head in accordance with the first embodiment of the present invention.
Figure 7:
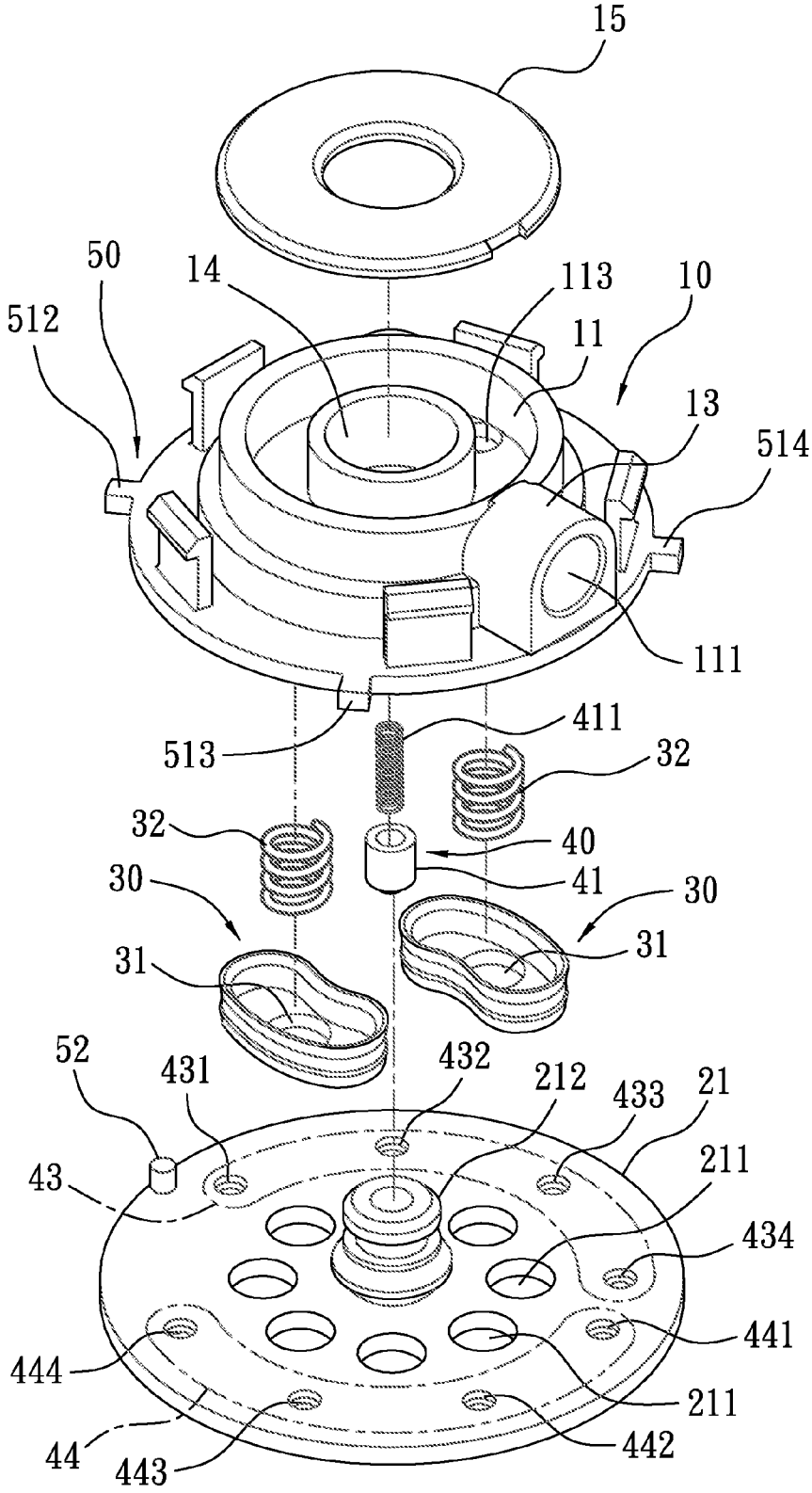
FIG. 7 is a perspective view showing a holder, an upper disc, two plugs, a rotatable positioning structure, and an adjustable levering assembly of the adjustable module spray head in accordance with the first embodiment of the present invention.

The holder 10, as illustrated in FIGS. 6 and 7, includes a passage 11 to flow water and two symmetrical slots 12 in communication with the passage 11 to flow water outward.

The passage 11 includes a channel 111, an annular room 112, and two mouths 113; one part of the channel 111 is formed in a joint 13 outward extending from the holder 10, the annular room 112 is disposed in the holder 10 and includes the mouths 113 mounted in two symmetrical portions on a bottom surface thereof respectively to communicate with the slots 12 of the holder 10. The holder 10 includes an axial notch 14 arranged at a central portion thereof and having a retaining periphery 141 secured on a middle section of the axial notch 14.

The annular room 112 includes an annular recess molded on a top end of the holder 10 and a circular cover 15 welded on the top end of the holder 10.

The distributing set 20 is operated to rotate relative to an outflow side of the holder 10 and to guide the water from the outflow side of holder 10 into an inner passageway and a cavity so as to spray water flower in predetermined watering mode. The distributing set 20 includes an upper disc 21, a middle disc 22, a lower disc 33, a decorative lip 24, a guiding member 25, an inflow member 26, a seal pad 27, and a rotating piece 28, wherein the upper disc 21, as shown in FIG. 7, includes eight circular inlets 211 arranged around a concentric central point thereof so that an angle between any two adjacent inlets 211 is 45 degrees, and any two symmetrical inlets 211 are taken as the same set of inlet 211, such that as water flows to the same set of the two inlets 211, it is guided to the same cavity to generate water flower in a predetermined watering mode, hence there are four sets of inlets 211 in this embodiment to generate four different modes of water flowers.

The upper disc 21 includes a shaft 212 extending upward from a center of a top surface thereof to be fitted to the axial notch 14 of the holder 10 and having a seal pad 213 fitted on the shaft 212 to engage with the axial notch 14 tightly and having a C-shaped retainer 214 fixed on the axial notch 14 to retain with the retaining periphery 141 of the holder 10, limiting the shaft 212 in the axial notch 14.

Figure 4:
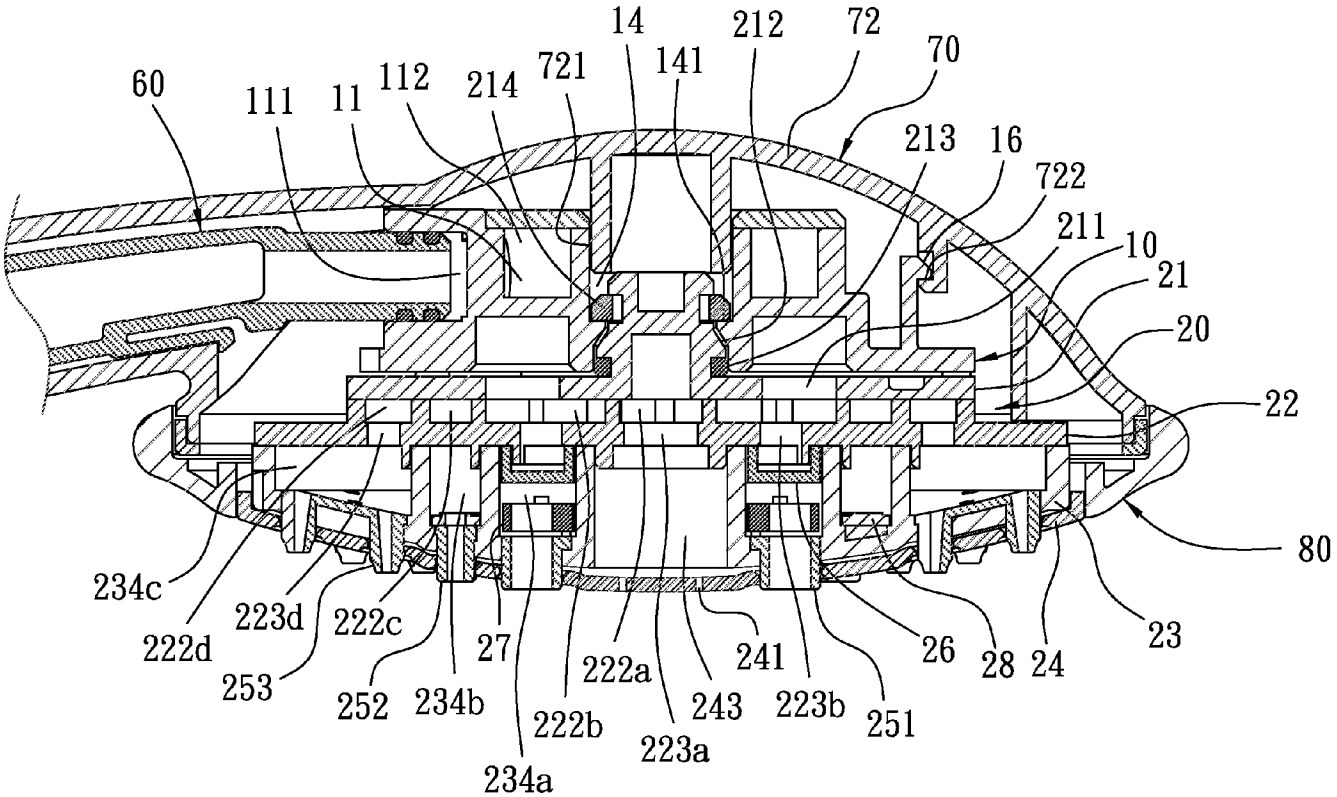
FIG. 4 is a cross sectional view showing the assembly of the adjustable module spray head in accordance with the first embodiment of the present invention.
Figure 5:
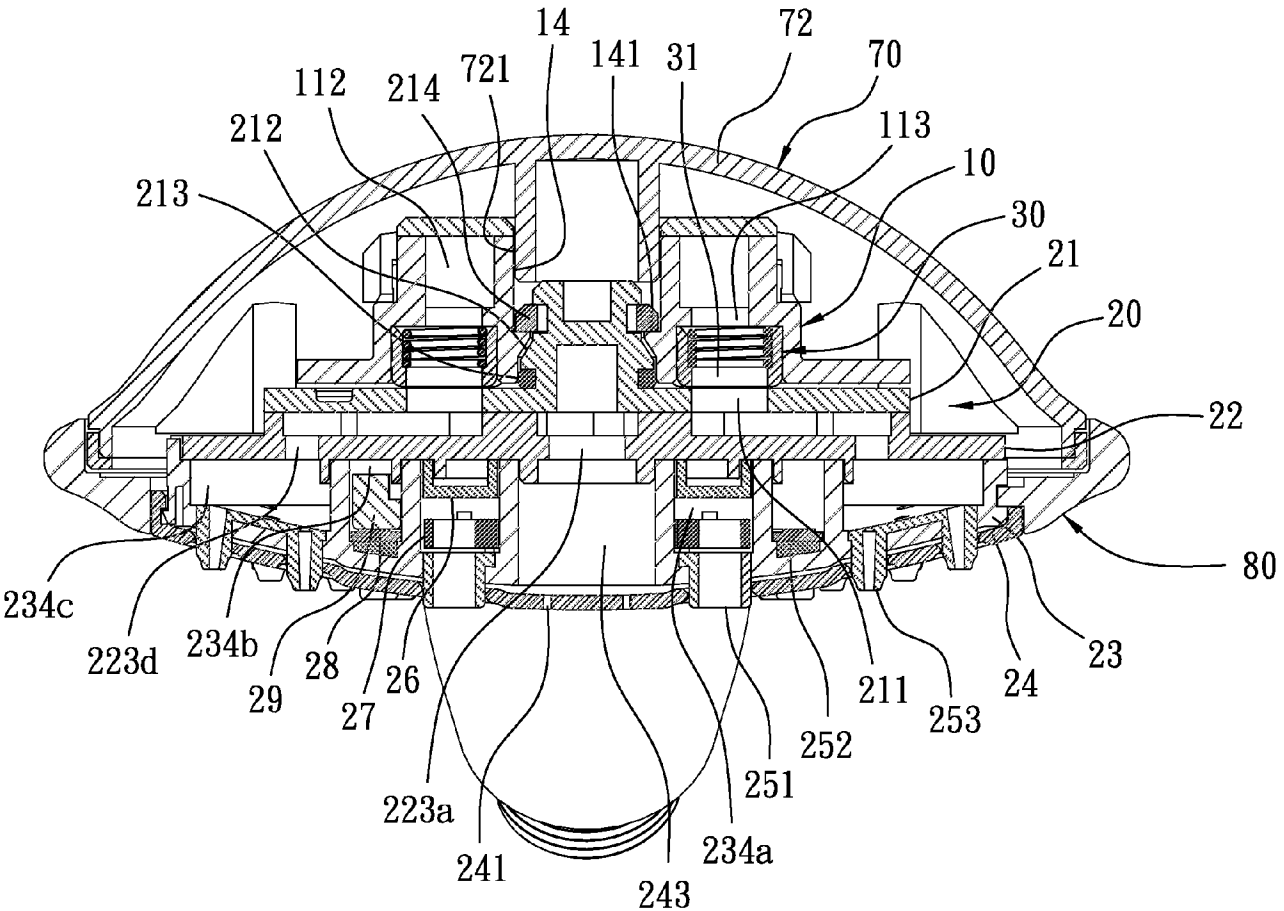
FIG. 5 is another cross sectional view showing the assembly of the adjustable module spray head in accordance with the first embodiment of the present invention.
Figure 8:
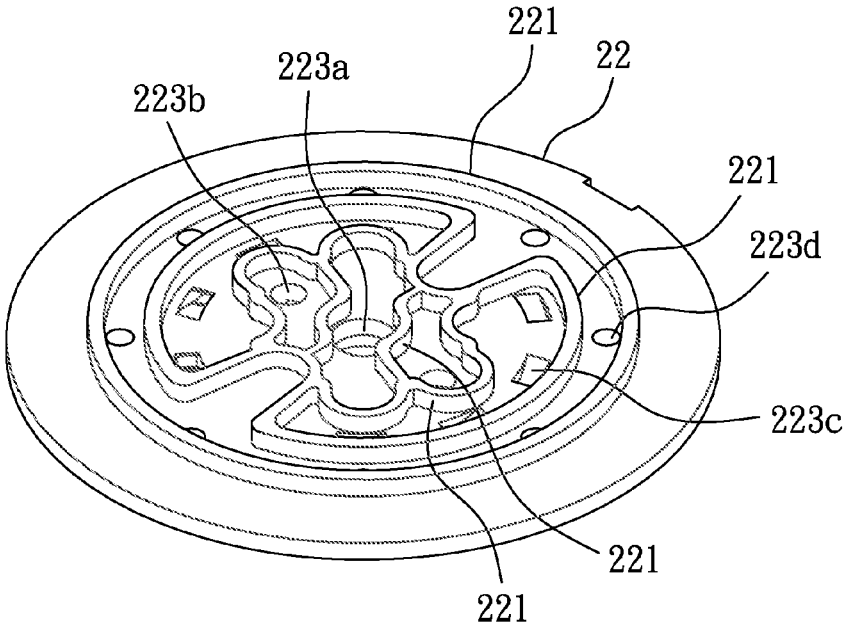
FIG. 8 is a perspective view showing the assembly of a middle disc of the adjustable module spray head in accordance with the first embodiment of the present invention.

Referring to FIG. 8, the middle disc 22 includes a plurality of fences 221 connecting or disconnecting with each other to define a number of closed trenches, and the top rims of the fences 221 are welded with the upper disc 21 so as to define a first upper chamber 222*a* between the fences 221 of the middle disc 22 and the upper disc 21, two second upper chambers 222*b* on two sides of the first upper chamber 222*a*, two third upper chambers 222*c* on two sides of the second upper chamber 222*b*, and a fourth upper chamber 222*d* as illustrated in FIG. 4; wherein the first, second, third, and fourth upper chambers 222*a*, 222*b*, 222*c*, 222*d* are in communication with a set of inlet 211 individually.

The middle disc 22 includes a first hole 223*a* disposed on a central portion thereof relative to the first upper chamber 222*a*, a second hole 223*b* mounted thereon relive to the second upper chambers 222*b*, four third holes 223*c* fixed thereon in relation to the third upper chambers 222*c*, and eight fourth holes 223*d* attached thereon relative to the fourth upper chamber 222*d*.

Figure 9:
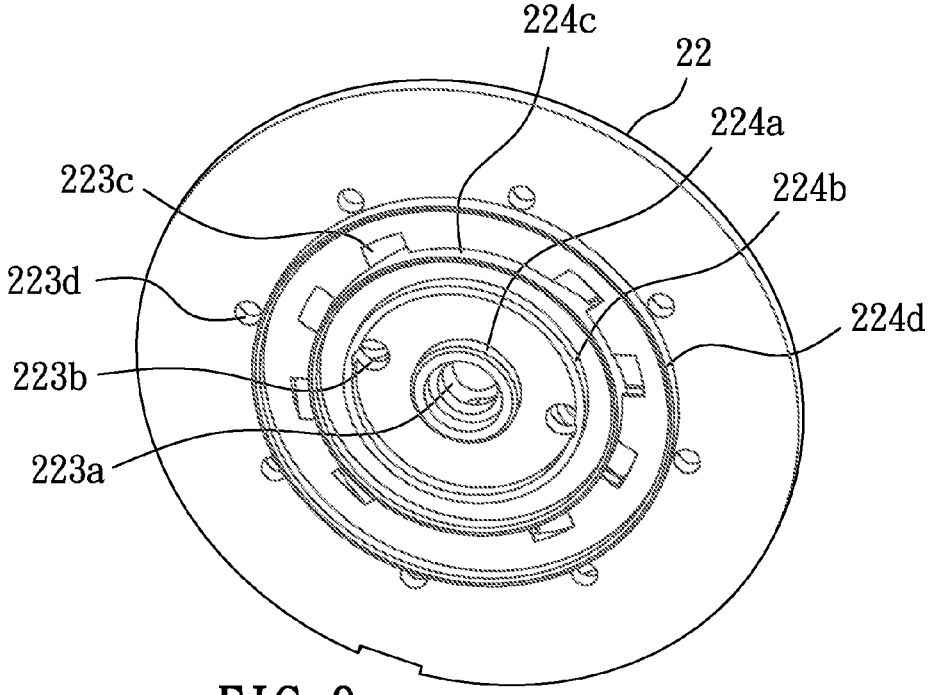
FIG. 9 is another perspective view showing the assembly of the middle disc of the adjustable module spray head in accordance with the first embodiment of the present invention.

With reference to FIG. 9, the middle disc 22 includes a first, a second, a third, and a fourth positioning walls 224*a*, 224*b*, 224*c*, 224*d*, all of which are arranged at a concentric point and from inside to outside in order; wherein the first hole 223*a* is located at the first positioning wall 224*a*, the second hole 223*b* is located between the first and the second positioning walls 224*a*, 224*b*, the third holes 223*c* are located between the third and the fourth positioning walls 224*c*, 224*d*, and the fourth holes 223*d* are located at an outer surface of the fourth positioning wall 224*d*.

Figure 10:
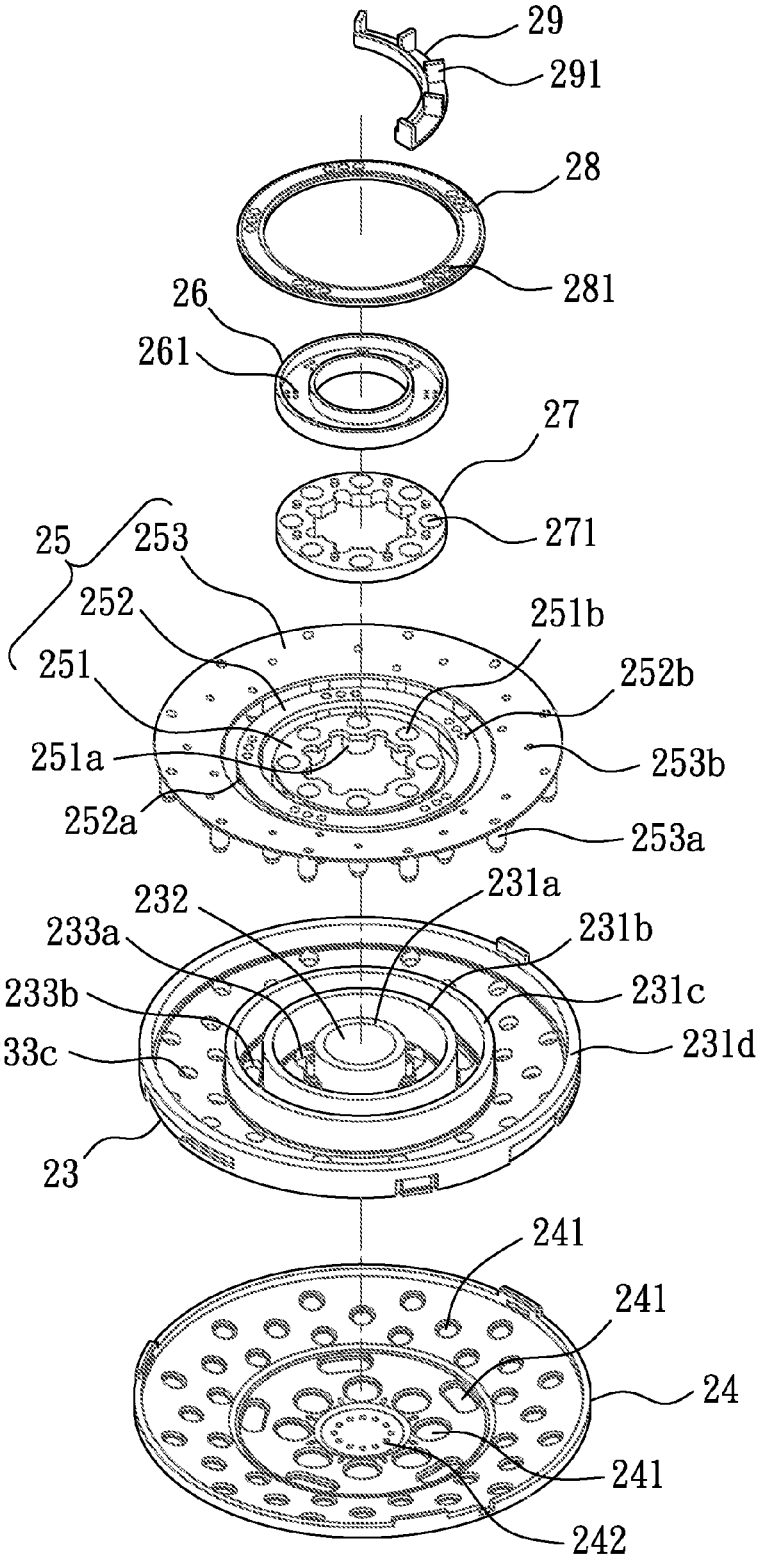
FIG. 10 is a perspective view showing the exploded components of a distributing set of the adjustable module spray head in accordance with the first embodiment of the present invention.

Referring to FIG. 10, the lower disc 23 includes a first, a second, a third, and a fourth isolating rims 231*a*, 231*b*, 231*c*, 231*d*, all of which are arranged at a concentric point and from inside to outside in order so as to abut against the first, the second, the third, and the fourth positioning walls 224*a*, 224*b*, 224*c*, and 224*d* respectively and then to be welded with the first, the second, the third, and the fourth positioning walls 224*a*, 224*b*, 224*c*, and 224*d* together, such that the middle disc 22 and the lower disc 23 include a second lower chamber 234*a* between the first and the second isolating rims 231*a* and 231*b*, and a third lower chamber 234*b* between the second and the third isolating rims 231*b* and 231*c*, and a fourth lower chamber 234*c* between the third and the fourth isolating rims 231*c* and 231*d*.

The lower disc 23 further includes a central bore 232 defined in the first isolating rim 231*a*, eight second outlets 233*a* defined between the first and the second isolating rims 231*a* and 231*b*, five third outlets 233*b* between the second and the third isolating rims 231*b* and 231*c*, and a plurality of fourth outlets 233*c* defined between the third and the fourth isolating rims 231*c* and 231*d*.

The decorative lip 24 is welded onto a bottom surface of the lower disc 23 and includes a number of apertures 241 communicating with the second, the third, and the fourth outlets 233*a*, 233*b*, 233*c*, and includes a plurality of first outlets 242 at a central portion thereof to communicate with the central bore 232, such that a first lower chamber 243 is defined between the middle disc 22, the first isolating rim 231*a* of the lower disc 23 and the decorative lip 24.

The spray assembly 25 includes an internal, a middle, and an external spraying members 251, 252, and 253 to be fixed in the second, the third, and the fourth lower chambers 234*a*, 234*b*, 234*c* in order, and includes a number of nozzles 251*a*, 252*a*, 253*a* passing though the second, the third, and the fourth outlets 233*a*, 233*b*, 233*c* of the lower disc 23, and the nozzles 251*a*, 253*a* include spouts 251*b*, 253*b*, the nozzle 252*a* includes three spouts 252*b* so that the water flowing to the second, the third, and the fourth lower chambers 234*a*, 234*b*, 234*c* sprays out of the spouts 251*b*, 252*b*, 253*b* of the nozzles 251*a*, 252*a*, 253*a* in a predetermined watering mode. In this embodiment, the spray assembly 25, the inflow member 26, the guiding member 27, the seal pad 28, and the rotating piece 29 are used to flow water through the first, the second, the third, and the fourth lower chambers 243, 234*a*, 234*b*, 234*c* to generate water flower in bubbled, jetted, massaged, and linear watering modes.

The inflow member 26 and the guiding member 27 are installed to upper and lower sides of the second lower chamber 234*a* and includes a number of apertures 261, 271 so that water in the second lower chamber 234*a* flows through the apertures 261, 271 and the nozzles 251*b* of the internal spraying member 251 to generate water flower in the jetted watering mode. Because the inflow member 26 and the guiding member 27 are well known, further remarks are omitted.

The seal pad 28 and the rotating piece 29 are installed to the third lower chamber 234*b*, wherein the seal pad 28 includes a plurality of apertures 281 arranged thereon, and the rotating piece 29 has a length equal to ¼ of impeller and a number of vanes 291 so that the water flows to the third lower chamber 234*b* to impact the vanes 291 of the rotating piece 29, hence the rotating piece 29 rotates along the seal pad 28 freely so as to stop the apertures 281 of the seal pad 28 intermittently, generating intermittent watering to have a massage. Because the seal pad 28 and the rotating piece 29 are well known, further remarks are omitted.

The plugs 30 are disposed to the slots 12 of the holder 10, and each has an opening 31 formed therein and a compression spring 32 to abut against the upper disc 21 of the distributing set 20. When the upper disc 21 rotates relative to the holder 10, the opening 31 of the plug 30 communicates with one set of the inlet 211 of the upper disc 21 to guide water from the passage 11 of the holder 10 to the inlet 211 to spray water flower in a predetermined mode, such as bubbled, jetted, massaged, and linear watering mode. It is to be noted that the plug 30 allows to communicate with two sets of inlets 211 so that water from the passage 11 of the holder 10 is guided to the two sets of inlets 211, generating water flower in double watering mode, such as massaged and bubbled, bubbled and jetted, jetted and linear, and linear and massaged watering mode.

Figure 2:
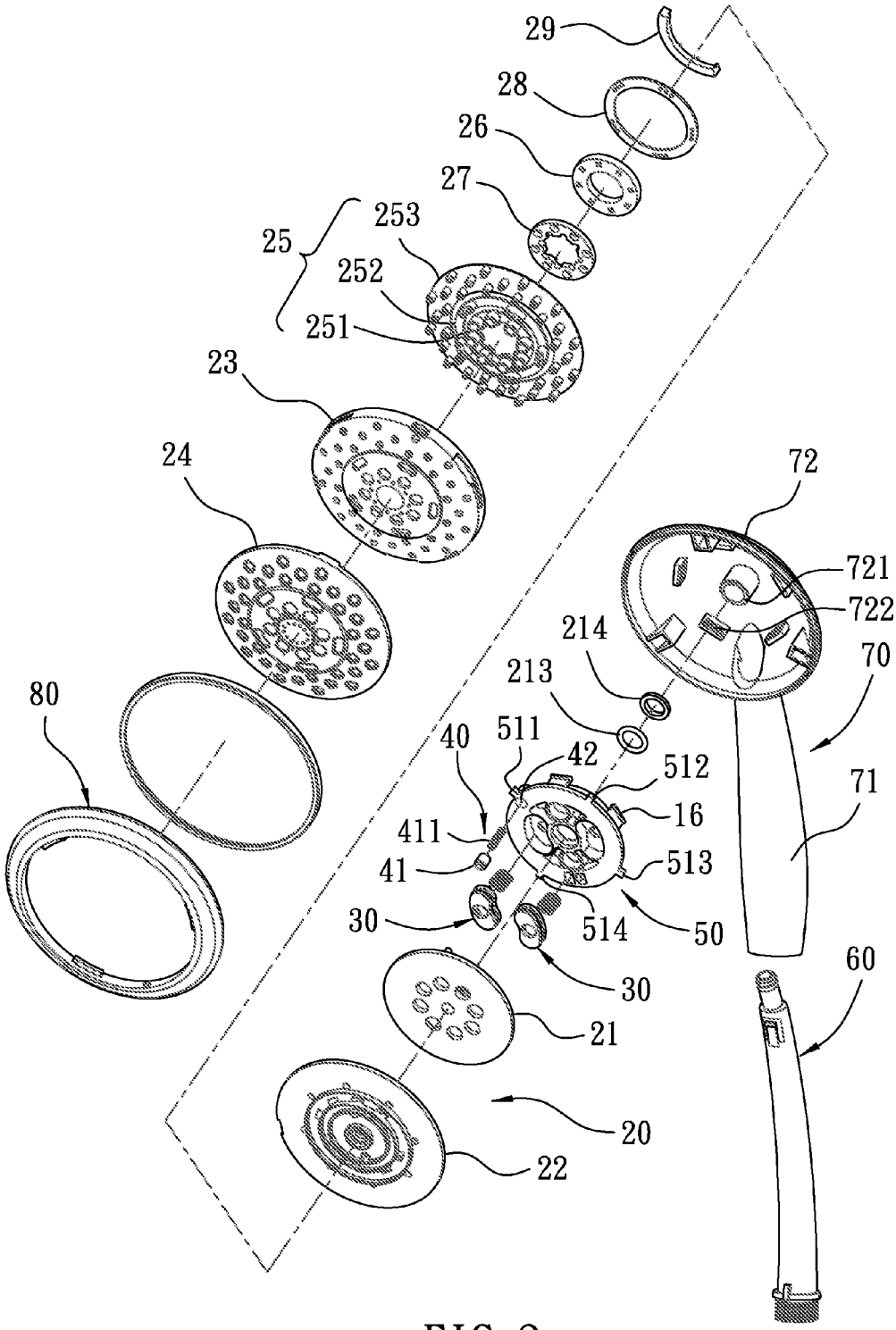
FIG. 2 is a perspective view showing the exploded components of the adjustable module spray head in accordance with the first embodiment of the present invention.
Figure 3:
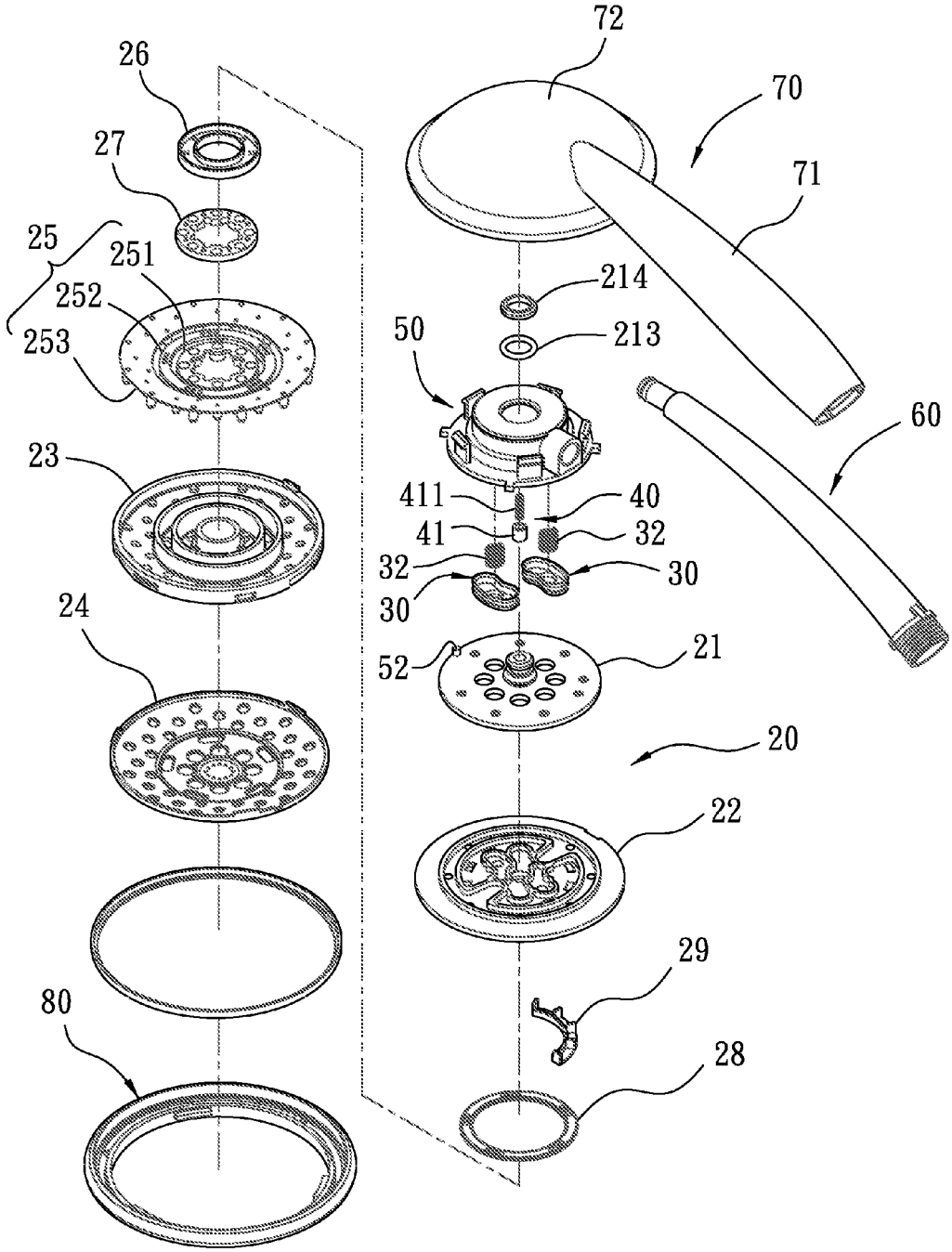
FIG. 3 is another perspective view showing the exploded components of the adjustable module spray head in accordance with the first embodiment of the present invention.

With reference to FIGS. 2 and 3, the rotatable positioning structure 40 includes a levering pin 41, a compression spring 411, a receiving groove 42, and a plurality of engaging orifices. The receiving groove 42 is disposed on the outflow side of a bottom surface of the holder 10 to receive the compression spring 411 and the levering pin 41 pushed by the compression spring 411; the engaging orifices are located at the concentric point of the inlets 211 to be retained by the levering pin 41, wherein the upper disc 21 includes eight engaging orifices to be divided into two areas, one area is a first rotary zone 43 and a second rotary zone 44 as shown in FIG. 7; the first rotary zone 43 includes four engaging orifices, e.g., a first, a second, a third, and a fourth engaging orifices 431, 432, 433, 434; the second rotary zone 44 includes four engaging orifices, e.g., a first, a second, a third, and a fourth engaging orifices 441, 442, 443, 444; between any two adjacent engaging orifices in the first and the second rotary zones 43, 44 is formed a 45 degree of first angle, and between the fourth and the first engaging orifices 434, 441 is formed a 22.5 degree of second angle.

The angle between the two adjacent engaging orifices of the first rotary zone 43 is equal to that between anyone set of inlet 221 so that as the levering pin 41 displaces from anyone engaging orifice of the first rotary zone 43 to another adjacent engaging orifice, the openings 31 of the plugs 30 of the holder 10 displace from one set of inlet 211 of the upper disc 21 to another set of inlet 211 adjacent to the one set of inlet 211 of the upper disc 21. In other words, as the levering pin 41 abuts against the first, the second, the third, the fourth engaging orifices 431, 432, 433, 434 of the first rotary zone 43 in order, the openings 31 of the plugs 30 communicate with the four sets of inlets 211 of the upper disc 21, generating water flower in the bubbled, jetted, massaged, and linear watering mode.

The angle between the fourth engaging orifice 434 of the first rotary zone 43 and the first engaging orifice 441 of the second rotary zone 44 is designed to 22.5 degrees so that as the levering pin 41 rotates from the fourth engaging orifice 434 to the first engaging orifice 441, the openings 31 of the plugs 30 of the holder 10 rotates from one set of inlet 221 of the upper disc 21 to the two sets of inlets 211. Besides, the angle between any two adjacent engaging orifices of the second rotary zone 44 is 45 degrees, therefore when the levering pin 41 contacts with the first, the second, the third, and the fourth engaging orifices 441, 442, 443, 444 of the second rotary zone 44, the openings 31 of the plugs 30 communicate with the two sets of inlets 221 to spray water flower in massaged and bubbled, bubbled and jetted, jetted and linear, linear and massaged double watering mode. Accordingly, the first and the second rotary zones 43, 44 are designed based on the number of the watering mode. For example, as the levering pin 41 is located at any engaging orifice of the first rotary zone, only one watering mode is obtained, however, as the levering pin 41 is located at any one engaging orifice of the second rotary zone 44, a double watering mode is achieved.

The adjustable levering assembly 50 includes four fixing projections radially extending from an peripheral side of the holder 10, and a rotor 52 extending upward form a top surface of the upper disc 21 of the distributing set 20; the fixing projections are a first, a second, a third, and a fourth stators 511, 512, 513, 514, and an angle between the first and the second stators 511, 512 is 90 degrees, an angle between the second and the third stators 512, 513 is 67.5 degrees, an angle between the third and the fourth stators is 90 degrees.

Figure 11:
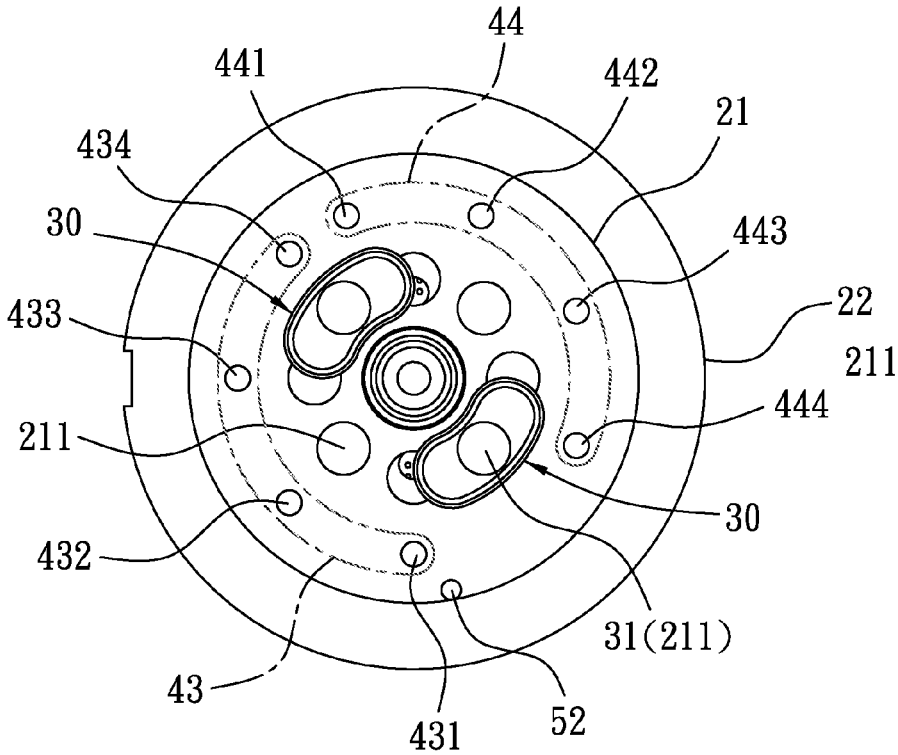
FIG. 11 is a top plan view showing the upper disc, a rotor, eight engaging orifices, the middle disc, and the two plugs of the adjustable module spray head in accordance with the first embodiment of the present invention.
Figure 12:
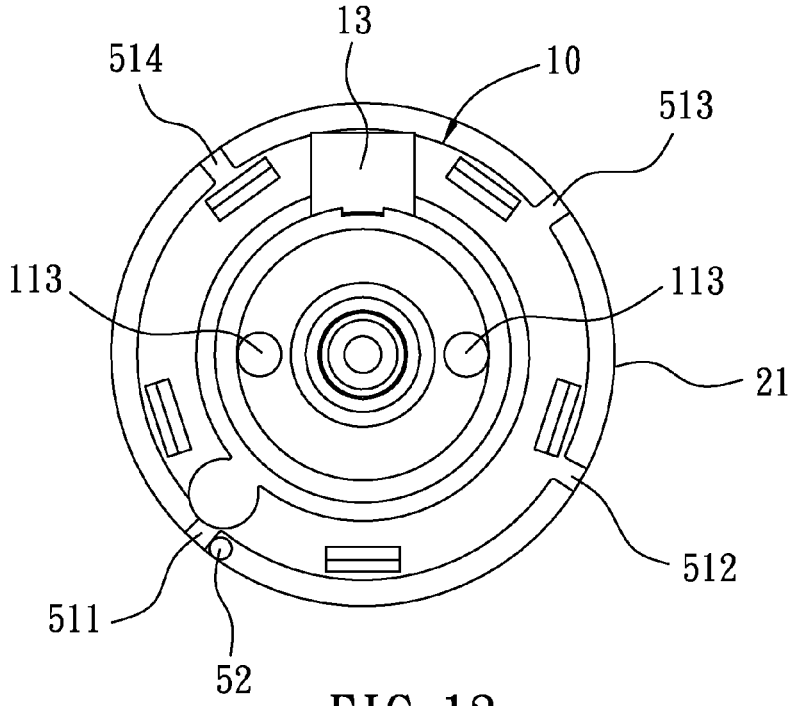
FIG. 12 is a top plan view showing the holder, the upper disc, a rotor and four stators of the adjustable levering assembly, and the rotor being limited between the first and the second stators in accordance with the first embodiment of the present invention.

As shown in FIG. 12, before the assembly of the distributing set 20 and the holder 10, the rotor 52 is limited between the first and the second stators 511, 512 to rotate so that as the rotor 52 is biased against the first stator 511, the levering pin 41 of the rotatable positioning structure 40 abuts against the first engaging orifice 431 of the first rotary zone 43, hence when the rotor 52 rotates 90 degrees from the first stator 511 toward the second stator 512, the levering pin 41 rotates from the first engaging orifice 431 to the third engaging orifice 433 via the second engaging orifice 432 as illustrated in FIG. 11 to achieve three single watering modes, e.g., bubbled, jetted, and massaged watering mode.

Figure 13:
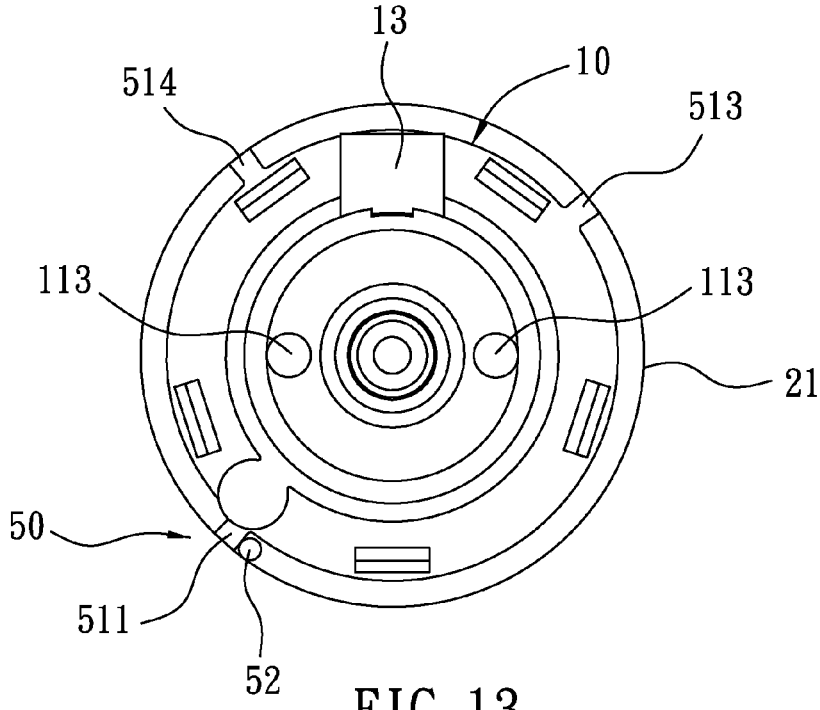
FIG. 13 is a top plan view showing the second stator of FIG. 12 has been removed in accordance with the present invention.

Referring further to FIG. 13, before the assembly of the distributing set 20 and the holder 10, the second stator 512 is manually removed or cut by tool in advance. Thereafter, the rotor 52 is additionally rotated 67.5 degrees to be up to 157.5 degrees so that a rotor 41 is rotated 157.5 degrees from the first engaging orifice 431 of the first rotary zone 43 to pass through the second, the third, and the fourth engaging orifices 432, 433, 434 toward the first engaging orifice 441 of the second rotary zone 44 as illustrated in FIG. 11 to generate four single and one double watering modes, such as bubbled, jetted, massaged, linear, and massaged and bubbled watering modes.

Figure 14:
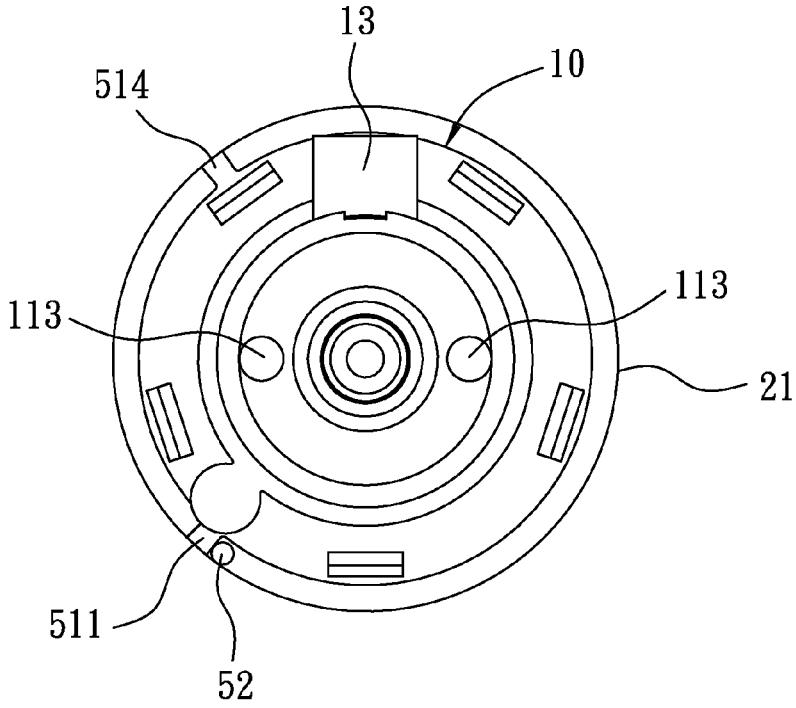
FIG. 14 is a top plan view showing the third stator of FIG. 13 has been removed in accordance with the present invention.

With reference to FIG. 14, before the assembly of the distributing set 20 and the holder 10, the second and the third stators 512, 513 are removed so that the rotor 52 is additionally rotated 67.5 and 90 degrees. In other words, the rotor 52 is rotated up to 247.5 degrees so that the rotor 41 is rotated 157.5 degrees from the first engaging orifice 431 of the first rotary zone 43 to the third engaging orifice 413 via the second, the third, and the fourth engaging orifices 432, 433, 434 of the first rotary zone 43 and the first and the second engaging orifices 441, 412 of the second rotary zone 44 as shown in FIG. 11 to generate four single and three double watering modes, such as bubbled, jetted, massaged, linear, massaged and bubbled, bubbled and jetted, and jetted and linear watering modes.

Similarly, the second stator 512, the third stator 513, and the fourth stator 514, and even though the first stator 511 can be removed together before assembling the distributing set 20 and holder 10, so the rotor 52 rotates at least over 292.5 degrees and even 360 degrees without any rotating limitation, such that the levering pin 41 is positioned in the engaging orifices of the first rotary zone 43 and the second rotary zone 44 so as to achieve four single watering modes and four double watering modes, such as water flower in a bubbled watering mode, a jetted watering mode, a massaged watering mode, and a linear watering mode, a massaged and bubbled watering mode, a bubbled and jetted watering mode, a jetted and linear watering mode, and a linear and massaged watering mode. Of course, if the rotor 52 is removed directly, the four single watering modes and the four double watering modes are achieved without removing any stators.

The watering feeding pipe 60 is in communication with the outflow side of the holder 10 to guide water into the passage 11 of the holder 10.

The housing 70 includes a grip portion 71 and a casing 72 extending from a distal end of the grip portion 71 to receive the holder 10, the distributing set 20, and the water feeding pipe 60. The casing 72 includes a pillar 721 fixed on an inner wall thereof to be removably inserted from the axial notch 14 of the holder 10, and includes a number of retaining recesses 722 attached on the inner wall thereof to retain a plurality of hooks 16 of the holder 10.

The rotating ring 80 is movably fitted to the housing 70 and fixed around the distributing set 20 so as to be driven to actuate the distributing set 20 to rotate in relation to the holder 10.

Thereby, the adjustable module spray head of the first embodiment of the present invention can provide four options, i.e., the three watering levels, the five watering levels, the seven watering levels, and the eight watering levels on the basis of demand, and the user assembles the adjustable module spray head with a required watering level easily according to the above-mentioned method, so an installing method of the adjustable module spray head comprises:

a. providing four kinds of watering levels before assembling the module core unit 2;

b. determining one of the following steps based on a selected watering level:

step of without removing, wherein the stators and the rotor 52 are not removed, and the rotor 52 is limited to rotate between the first and the second stators 511, 512 to assemble the module core unit 2 to achieve three watering levels (e.g., the lowest watering level) in single watering mode;

first removing step, wherein at least one stator is removed, such as the second stator 512 or the second and the third stators, and the rotor 52 is assembled with the two rotating stators in different directions to form the module core unit 2, thereby generating five or seven watering levels;

second removing step, wherein all stators or the rotor or the stators except for the first stator 511 are removed, and the levering pin 41 is fixed with any engaging orifice of the first and the second rotary zones 43, 44 to form the module core unit 2, thus obtaining eight watering levels, e.g., the most watering level;

c. assembling the module core unit 2 to the spray head 1, having a customized and module spray head 1.

Figure 15:
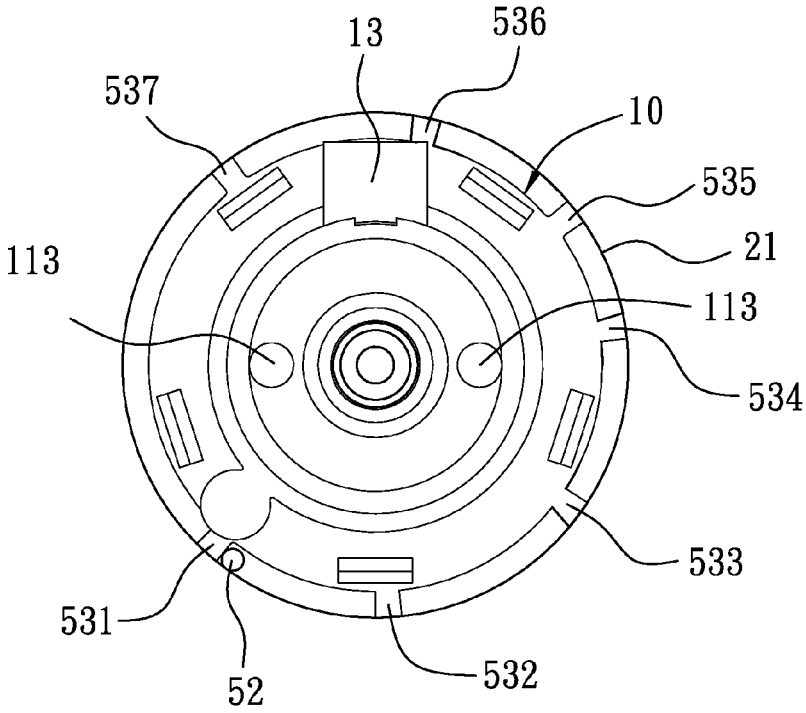
FIG. 15 is a plan view showing the assembly of a module core unit of an adjustable module spray head in accordance with a second embodiment of the present invention.
Figure 16:
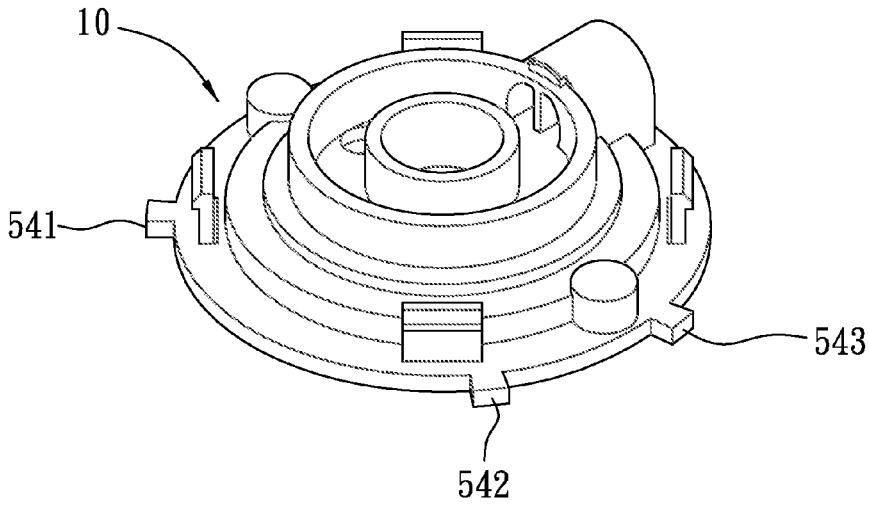
FIG. 16 is a perspective view showing the assembly of a module core unit of an adjustable module spray head in accordance with a third embodiment of the present invention.
Figure 17:
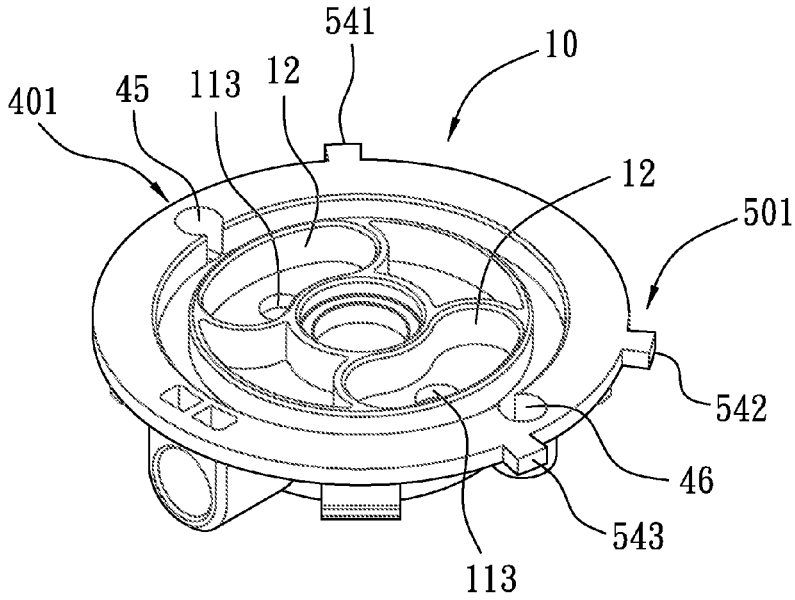
FIG. 17 is another perspective view showing the assembly of the module core unit of the adjustable module spray head in accordance with the third embodiment of the present invention.

As illustrated in FIG. 15, an adjustable module spray head 1 in accordance with a second embodiment of the present invention comprises a first, a second, a third, a fourth, a fifth, a sixth, and a seventh stators 531, 532, 533, 534, 535, 536, and 537, an angle between any two abutting stators is 45, 90, 135, 157.5, 202.5, and 247.5 degrees. When the rotor is limited between the first and the second stators 531, 532, two watering modes are achieved. When the second stator 532 is removed, three watering modes are generated. Likewise, as the second, the third, the fourth, the fifth, the sixth, and the seventh stators 532, 533, 534, 535, 536, and 537 are removed or all of the stators are removed or only the rotor 52 is removed, eight watering modes are obtained. The adjustable module spray head of the second embodiment of the present invention provides more stators than that of the first embodiment to divide more spaces for limiting the rotation of the rotor 52, thus providing more options, including two watering levels, three watering levels, four watering levels, five watering levels, six watering levels, seven watering levels, eight watering levels, i.e. seven options. Thereby, different watering levels are provided to user to satisfy different demands Referring to FIGS. 16-19, an adjustable module spray head according to a third embodiment of the present invention includes a rotatable positioning structure 401 having a levering pin 41 and a plurality of engaging orifices, and includes an adjustable levering assembly 501 having a rotor 52 and a number of stators.

The rotatable positioning structure 401 includes a receiving groove and ten engaging orifices, and a spaced angle between the engaging orifices is different from that of the first and the second embodiments of the present invention. The rotatable positioning structure 401 includes a first receiving groove 45 and a second receiving groove 46 disposed on an outer rim of the outflow side of the holder 10 to receive the compression spring 411 and the levering pin 41 in one of the first and the second receiving grooves 45, 46. The ten engaging orifices are divided into two rotary zones, e.g., a first rotary zone 47 and a second rotary zone 48, wherein the first rotary zone 47 includes a first, a second, and a third engaging orifices 471, 472, and 473, wherein between any two adjacent engaging orifices is formed a 45 degree of first angle.

The second rotary zone 48 includes a first, a second, a third, a fourth, a fifth, a sixth, and a seventh engaging orifices 481, 482, 483, 484, 485, 486, and 487, wherein between any two adjacent engaging orifices is formed a 22.5 degree of second angle (equal to ½ of first angle), and at a connection of the first and the second rotary zones 47, 48 are provided the first engaging orifice 471 and the seventh engaging orifice 487 between which a 45 degree of angle is formed.

The adjustable levering assembly 501 includes a first, a second, and a third stators 541, 542, 543, and an angle between the first and the second stators 541, 542 is 90 degrees, yet an angle between the second and the third stators 542, 543 is 22.5 degrees.

The adjustable module spray head of the third embodiment of the present invention can also generate three single watering modes (e.g., bubbled, linear, and massaged watering mode), five single and double watering modes (e.g., bubbled, bubbled and linear, linear, linear and massaged, and massaged watering mode), and seven single and double watering modes (e.g., bubbled, bubbled and linear, linear, linear and massaged, massaged, massaged and jetted, and jetted watering mode).

As mentioned in the first embodiment and the second embodiment, before assembling the distributing set 20 and the holder 10, the levering pin 41 is fixed in the first receiving groove 45 or the second receiving groove 46, and then the rotor 52 is limited to rotate between the first stator 541 and the second stator 542 so as to connect the distributing set 20 with the holder 10. It is to be noted that when the levering pin 41 is fixed in the first receiving groove 45 and the rotor 52 rotates 90 degrees toward the second stator 542 from the first stator 541, the levering pin 41 rotates toward the third engaging orifice 473 of the first rotary zone 47 from the first engaging orifice 471 of the first rotary zone 47 via the second engaging orifice 472 of the first rotary zone 47, thereby generating three single watering modes, e.g., the bubbled watering mode, the linear watering mode, and the massaged watering mode.

Similarly, when the levering pin 41 is fixed in the second receiving groove 46 and the rotor 52 is rotated 90 degrees toward the second stator 542 from the first stator 541, the levering pin 41 rotates 90 degrees toward the fifth engaging orifice 485 of the second rotary zone 48 from the first engaging orifice 481 of the second rotary zone 48 via the second engaging orifice 482, the third engaging orifice 483, and the fourth engaging orifice 484 of the second rotary zone 48, thus generating five interactive single and double watering modes, such as the bubbled watering mode, the bubbled and linear watering mode, the linear watering mode, the linear and massaged watering mode, and the massaged watering mode.

Similarly, the levering pin 41 is fixed in the second receiving groove 46, the second stator 542 is removed, and the distributing set 20 is connected with the holder 10 such that the rotor 52 is rotated toward the third stator 543 from the first stator 541. Accordingly, the rotor 52 is rotated 90 degrees toward the second stator 542 from the first stator 541 and then is further rotated 45 degrees toward the third stator 543 from the first stator 541, thereby rotating 135 degrees totally. So, the levering pin 41 rotates 135 degrees toward the seventh engaging orifice 487 of the second rotary zone 48 from the first engaging orifice 481 of the second rotary zone 48 via the second engaging orifice 482, the third engaging orifice 483, the fourth engaging orifice 484, the fifth engaging orifice 485, and the sixth engaging orifice 486 of the second rotary zone 48 to generate seven interactive single and double watering modes, such as the bubbled watering mode, the bubbled and linear watering mode, the linear watering mode, the linear and massaged watering mode, the massaged watering mode, the massaged and jetted watering mode, and the jetted watering mode.

the adjustable module spray head of the first embodiment of the present invention can provide four options, i.e., the three watering levels, the five watering levels the seven watering levels, and the eight watering levels on the basis of demand, and the user assembles the adjustable module spray head with the required watering level easily according to the above-mentioned method, so an installing method of the adjustable module spray head comprises:

Thereby, the adjustable module spray head of the third embodiment of the present invention can provide three options. i.e., the three watering levels, the five watering levels, and the seven watering levels based on demand, and the user assembles the adjustable module spray head with the required watering level easily according to the above-mentioned method, so an installing method of the adjustable module spray head comprises:

a. providing three kinds of watering levels before assembling the module core unit 2;

b. installing the levering pin 41 to the first or the second receiving groove 45 or 46 and determining one of the following steps on the basis of selected watering level:

step of without removing, wherein the stators and the rotor 52 are not removed, and the rotor 52 is limited to rotate between the first and the second stators 541, 542 to assemble the module core unit 2, when the levering pin 41 is selectively installed to the first receiving groove 45 and the step of the without removing is finished, the finished module core unit 2 will form three watering levels (e.g., the lowest watering level) in single watering mode; and when the levering pin 41 is selectively installed to the second receiving groove 46 and the step of the without removing is finished, the finished module core unit 2 will generate five watering levels in single and double watering mode;

step of removing, wherein the selected second stator 542 is removed, and the rotor 52 is limited to rotate between the first stator 541 and the second stator 542 to assemble the module core unit 2; and when the levering pin 41 is selectively installed to the second receiving groove 46 and the step of the removing is finished, the finished module core unit 2 will generate seven watering levels (e.g., the most watering level) in single and double watering mode;

c. assembling the module core unit 2 to the spray head 1, having a customized and module spray head 1.

It is to be noted that an additional engaging orifice can be arranged in the rotary zone, and the first rotary zone 47 is provided the fourth engaging orifice 474 so that between the first and the fourth engaging orifices 471, 474 is formed a 135 degree of angle, hence as the levering pin 41 is installed to the first receiving groove 45 and the second stator 542 is removed, the rotor 52 rotates 135 degrees from the first stator 541 to the third stator 543, and the levering pin 41 rotates 135 degrees from the first engaging orifice 471 of the first rotary zone 47 to the fourth engaging orifice 474 via the second and the third engaging orifices 472, 473, obtaining four single watering modes, such as bubbled, linear, massaged, and jetted watering mode to be selected by user.

In this embodiment, in each rotary zone of the module core unit are arranged two adjacent engaging orifices between which a specific angle is formed, and on the connection of the two rotary zones are fixed two adjacent engaging orifices between which another specific angle is formed so that the engaging orifices in the first rotary zone 47 are in response to the symmetrical engaging orifices in the second rotary zone 48 individually, such that two symmetrical engaging orifices are in response to the same watering mode (the same set of inlet 211) to match with original four sets of inlets 211.

It is to be noted that the angle spaced among the inlets 211 as mentioned in the embodiments of the present invention is based on the range among the central points or the central positions of the inlets 211 in the circumferential direction. Also, the angle spaced among the engaging orifices is based on the range among the central points or the central positions of the engaging orifices in the circumferential direction.

In addition, the angle between any two adjacent stators is based on the central positions of the stators. Of course, to prevent the width of the stators along the circumferential direction from being too large to influence the rotating angle range of the rotor 52 and the connecting positions of the opening 31 of the plugs 30, the width of the stators has to be limited. Although the width of the stators may cause the openings 31 of the plugs 30 not match with the inlets 211, if the error angle is still in an acceptable range, the watering efficiency will not be influenced. Besides, a size of the openings 31 of the plugs 30 can be increased to be larger than a size of the inlets 211 in the circumferential direction to obtain a compensation effect so that in an acceptable deviation angle, the openings 31 can include the inlets 211 to overcome above-mentioned problem.

The levering pins and the engaging orifices of the rotatable positioning structures of the embodiments of the present invention are fixed on outlet sides of the holders 10 and inlet sides of the distributing set 20 respectively but not be limited to such a requirement. i.e., the arrangement can be changed to achieve the same positioning function. Similarly, the stator and the rotor of the adjustable levering assembly 50 allow to be fixed at different positions but obtain the same adjustable levering function.

Figure 18:
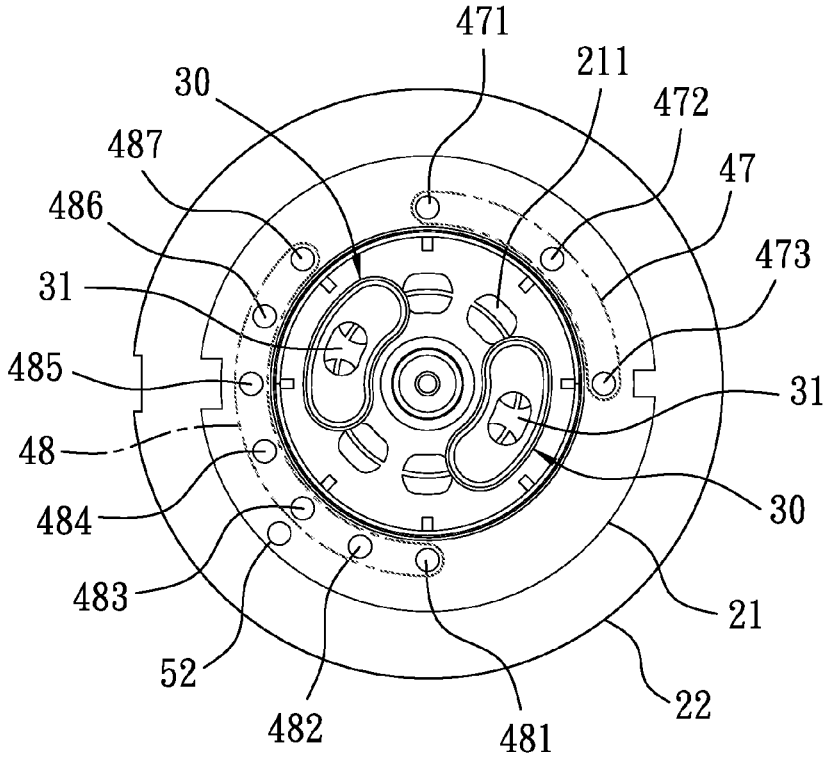
FIG. 18 is a top plan view showing the assembly of the module core unit of the adjustable module spray head in accordance with the third embodiment of the present invention.
Figure 19:
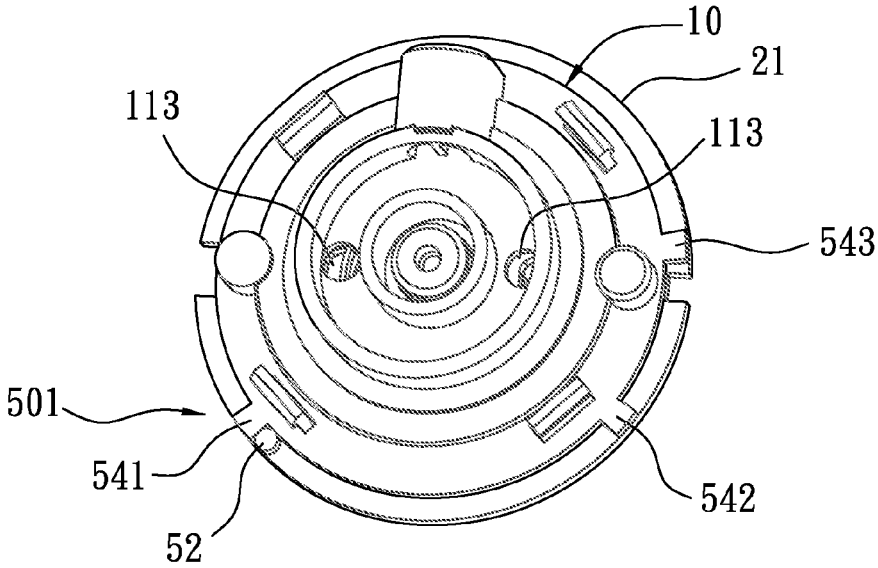
FIG. 19 is another perspective view showing the assembly of the module core unit of the adjustable module spray head in accordance with the third embodiment of the present invention.

The two plugs 30 are used to urge water to flow into the inlets 211 increasingly, enhancing watering efficiency. For example, in double watering mode, due to the opening 31 of the plug 30 is in communication with two inlets 211 so that one half or one part of the inlet 211 is included in the opening 31, therefore as an included area of the inlet 211 becomes more and more, the watering efficiency is increased. As shown in FIG. 18, the opening 31 is formed in an elongated arc shape and the shape of the inlet 211 is in relation to that of the opening 31.

The module core unit 2 is assembled to various spray heads with different watering levels to satisfy different demands, thus lowering mold, maintenance, and related parts costs.

The module spray head of the present invention is assembled by selecting the installing position of levering pin and removing specific stator or rotor, thus assembling easily and quickly.

The two plugs 30 are used to urge water to increase stability between the holder 10 and the distributing set 20 to prevent from slanted swing, thereby having stable watering flow. Also, different watering levels of the module spray head are achieved to meet any demand.

While we have shown and described various embodiments in accordance with the present invention, it is clear to those skilled in the art that further embodiments may be made without departing from the scope of the present invention.

What is claimed is:

1. An adjustable module spray head comprising a module core unit to spray water flowers in various watering modes, the module core unit further comprising a holder including a passage to flow water and two symmetrical slots in communication with the passage to flow water outward;

a distributing set operated to rotate relative to an outflow side of the holder and including a plurality of sets of inlets, each set having two symmetrical inlets arranged around a concentric central point of the distributing set; the distributing set also including a plurality of outlets disposed on an outflow side thereof, and a plurality of chambers, each communicating with the plurality of sets of inlets and the plurality of outlets so that water from each set of inlet flows through one of the plurality of chambers corresponding to the each set of inlet to be sprayed outward from each outlet in different watering modes;

two plugs disposed to the slots of the holder to abut against an inflow side of the distributing set, and each plug having an opening formed therein so that when the distributing set rotates, the opening of the each plug communicates with one of the plurality of sets of inlets to guide water from the holder to each inlet relative to the opening;

a rotatable positioning structure fixed between the holder and the distributing set and including a levering pin, a first receiving groove, a second receiving groove, and a plurality of engaging orifices located in a first rotary zone and a plurality of engaging orifices in a second rotary zone; wherein the first and the second receiving grooves are symmetrical to each other, and between any two adjacent engaging orifices in the first zone is formed a first angle, between two adjacent engaging orifices in the second rotary zone is formed a second angle equal to ½ of the first angle, and any one of the plurality of engaging orifices in the first rotary zone is symmetrical to one of the plurality of engaging orifices in the second rotary zone so that the levering pin is installed to one of the first receiving groove and the second receiving groove, as the levering pin is installed to the first receiving groove, the levering pin is retained with each of the plurality of engaging orifices in the first rotary zone with rotation of the distributing set to generate a plurality of single watering modes; as the levering pin is installed in the second receiving groove, the levering pin is retained with each of the plurality of engaging orifices in the second rotary zone with rotation of the distributing set to generate a plurality of single and double watering modes;

an adjustable levering assembly fixed between the holder and the distributing set and including a plurality of stators and a rotor; wherein the rotor is limited to rotate between two selected stators so that the levering pin rotates between at least two engaging orifices in the first rotary zone or between at least three engaging orifices in the second rotary zone; as at lease one stator is removed before assembling the holder and the distributing set to increase a rotating angle of the rotor, the levering pin is limited to rotate in the first rotary zone or in at least one engaging orifice of the second rotary zone until all engaging orifices of the first rotary zone or all engaging orifices of the second rotary zone are covered, hence the plugs are controlled at least three different angles to communicate with the inlets, thereby obtaining three different watering levels.

2. The adjustable module spray head as claimed in claim 1, wherein the first receiving groove and the second receiving groove are disposed on the outflow side of the holder, and the engaging orifices are fixed on the inflow side of the distributing set; the plurality of stators of the adjustable levering assembly are secured around the holder, and the rotor is mounted around the distributing set.

3. The adjustable module spray head as claimed in claim 1, wherein the distributing set includes eight inlets of the plurality of sets of inlets arranged around a concentric central point thereof to form four sets of inlets so that an angle between any two adjacent inlets is 45 degrees, the first rotary zone includes three engaging orifices, and the second rotary zone includes seven engaging orifices, and the first angle is 45 degrees and the second angle is 22.5 degrees; the adjustable levering assembly includes three stators which is a first stator, a second stator, and a third stator; an angle between the first stator and the second stators is 90 degrees, an angle between the second stator and the third stators is 22.5 degrees, and the rotor is limited to rotate between the first stator and the second stators, the levering pin is located at any one of the three engaging orifices in the first rotary zone or any one of the five engaging orifices in the second rotary zone; the rotor is limited to rotate between the first stator and the third stator by removing the second stator, so that the levering pin is located at any one of the seven engaging orifices in the second rotary zone.

4. The adjustable module spray head as claimed in claim 1, wherein the distributing set includes an upper disc, a middle disc, a lower disc, and a decorative lip; the upper disc includes the inlets arranged on a top surface thereof to define a plurality of upper chambers between the upper disc and the middle disc to communicate with the plurality of inlets; between the middle disc, the lower disc, and the decorative lip are arranged a plurality of lower chambers, and the middle disc includes a plurality of holes to communicate with the upper chamber and the lower chamber; the lower disc and the decorative lip include at least one of the plurality of outlets relative to each of the plurality of lower chambers so that water from the each set of inlets is guided to each of the plurality of lower chambers corresponding to the at least one of the plurality of outlets through each corresponding of the plurality of upper chambers, each corresponding of the plurality of holes and the at least one of the plurality of outlets to spray water flower in different watering modes via the outlets.

5. The adjustable module spray head as claimed in claim 4, wherein the upper disc includes four sets of inlets, and between the upper disc and the middle discs are defined a first upper chamber, two second upper chambers on two sides of the first upper chamber, two third upper chambers on two sides of the second upper chamber, and a fourth upper chamber; the upper chambers are in communication with one of the plurality of sets of the inlets; between the middle disc, the lower disc, and the decorative lip are arranged a first chamber, a second chamber, a third chamber, and a fourth lower chambers to communicate with the first chamber, the second chamber, the third chamber, the fourth upper chambers through the plurality of holes.

6. The adjustable module spray head as claimed in claim 5, wherein the distributing set is used to make water through the first chamber, the second chamber, the third chamber, and the fourth lower chamber generate a bubbled mode, a jetted mode, a massage mode, and a linear watering mode.

7. The adjustable module spray head as claimed in claim 4, wherein the holder includes an axial notch arranged at a central portion thereof; the upper disc includes a shaft extending upward from a center of a top surface thereof to be fitted to the axial notch of the holder.

8. The adjustable module spray head as claimed in claim 1 further comprising a watering-feeding pipe, a housing, and a rotating ring, wherein the watering-feeding pipe communicates with the inflow side of the holder to guide water to the passage of the holder; the housing includes a grip portion and a casing extending from a distal end of the grip portion to receive the holder, the distributing set, and the water feeding pipe; the rotating ring is fitted to the housing and to fixed around the distributing set so as to be actuated to rotate the distributing set and the holder relative to each other.

9. The adjustable module spray head as claimed in claim 8, wherein the holder includes an axial notch arranged at a central portion thereof; the casing includes a pillar fixed on an inner wall thereof to be removably inserted from the axial notch of the holder.

* * * * *